US005221051A

United States Patent [19]

Hashimoto et al.

[11] Patent Number: 5,221,051

[45] Date of Patent: Jun. 22, 1993

[54] CRUSHING APPARATUS AND CRUSHING METHOD

[75] Inventors: Isao Hashimoto, Akashi; Seisuke Sawamura; Hiroshi Ueda, both of Kobe; Yuji Yamamoto, Himeji; Kanzaburo Sutoh, Saitama; Mitsunari Ichikawa, Kumagaya; Tsuneichi Shitara, Chichibu, all of Japan

[73] Assignee: Kawasaki Jukogyo Kabushiki Kaisha, Hyogo, Japan

[21] Appl. No.: 879,289

[22] Filed: May 7, 1992

[30] Foreign Application Priority Data

May 14, 1991 [JP] Japan ..... 3-109146

[51] Int. Cl.[5] ..... B02C 23/08

[52] U.S. Cl. ..... 241/29; 241/97; 241/152.2

[58] Field of Search ..... 241/29, 37, 35, 152.2, 241/97

[56] References Cited

U.S. PATENT DOCUMENTS

| | | | |
|---|---|---|---|
| 2,652,984 | 9/1953 | Dodds | 241/35 |
| 4,485,974 | 12/1984 | Lass | 241/30 |
| 4,638,952 | 1/1987 | Williams et al. | 241/3 |
| 4,783,011 | 11/1988 | Blasczyk et al. | 241/24 |
| 4,804,148 | 2/1989 | Etheridge | 241/35 |
| 4,889,289 | 12/1989 | Lohnherr et al. | 241/18 |

FOREIGN PATENT DOCUMENTS

| | | |
|---|---|---|
| 0054344 | 6/1982 | European Pat. Off. . |
| 0352192 | 1/1990 | European Pat. Off. . |
| 61-238349 | 10/1986 | Japan . |
| 63-116751 | 5/1988 | Japan . |
| 89/10790 | 11/1989 | World Int. Prop. O. . |

*Primary Examiner*—Mark Rosenbaum
*Assistant Examiner*—John M. Husar
*Attorney, Agent, or Firm*—Oliff & Berridge

[57] ABSTRACT

Materials such as cement clinker are crushed by utilizing a crushing apparatus including a vertical roller mill provided with a rotatable table and a plurality of rollers and a distributing device for distributing materials preliminarily crushed by the vertical roller mill. The materials to be crushed is fed into the vertical roller mill, the materials are crushed between the table and the rollers by a pressing force applied to the rollers and substantially the whole amount of the crushed materials is then taken out from the vertical roller mill and conveyed to the distributing device. The crushed materials once conveyed to the distributing device is returned partially as they are to the vertical roller mill and again crushed together with the materials newly fed into the vertical roller mill. The materials are returned to the vertical roller mill by about 20% or more in weight ratio with respect to the newly fed materials when cement clinker is utilized as the materials to be crushed. The returning amount of the crushed materials are controlled in accordance with a power consumption of the rotatable table of the vertical roller mill, and the pressing force of the rollers is controlled in accordance with a power consumption of the rotatable table of the vertical roller mill. The crushed materials are fed to a tube mill installed downstream the vertical roller mill for carrying out a secondary crushing operation.

8 Claims, 11 Drawing Sheets

CRUSHING APPARATUS AND CRUSHING METHOD

BACKGROUND OF THE INVENTION

The present invention relates to a crushing apparatus and a crushing method.

In prior art, it is known to preliminarily coarsely crush materials to be crushed such as cement clinker, cement material, slug, ores and the like by utilizing a vertical roller mill which is excellent in coarse crushing efficiency. The thus coarsely crushed materials are thereafter finely crushed by utilizing a tube mill, for example, which is excellent in fine crushing efficiency.

One of examples of such prior art is disclosed in, for example, the Japanese Patent Laid-Open Publication No. 238349/1986, which is shown in FIG. 10.

FIG. 10 shows a schematic diagram of a crushing apparatus for crushing materials such as cement clinker and referring to FIG. 10, materials to be crushed fed into a vertical roller mill 2 through a material feed port 1 are coarsely crushed in the vertical roller mill 2. The crushed materials are then fed towards a separator 4 through a bucket elevator 3. The coarsely crushed materials classified in the separator 4 in accordance with the sizes of the materials are guided into a tube mill 5 in which the coarsely crushed materials are further crushed finely. The finely crushed materials are returned to the separator 4 through the bucket elevator 3. The finely crushed materials returned to the separator 4 are again classified and then taken out as products through a chute 6. Dust is collected by a dust collector.

Such crushing apparatus as shown in FIG. 10 may be called "one-pass crushing apparatus" because one crushing process is performed by the vertical roller mill 2. In such one-pass crushing apparatus, the materials to be crushed are coarsely crushed in the vertical roller mill 2, and for example, cement clinker having a grain size of 50 mm to 1 mm is crushed to grains having a size of 15 mm to 0.01 mm. The vertical roller mill 2 generally includes a table rotatable around its perpendicular axis and a plurality of rollers arranged on the table in a circumferentially spaced relationship.

The materials are fed through the inlet port 1 on substantially the central portion of the table of the vertical roller mill 2 and then crushed in a gap between the rotating table and the rollers by biting the materials in the gap and then applying pressure to the rollers. For this crushing operation, a perpendicularly downwards-acting large pressing force is applied to the rollers by a pressing means such as hydraulic cylinder means thereby causing large pressing force between the rollers and the table.

Accordingly, in the utilization of the vertical roller mill of the structure described above, large vibration is generated irrespective of the sizes of the materials to be crushed. The generation of such large vibrations constitutes a significant problem for persons who design the crushing apparatus to reduce them to as small as possible.

In a case where such vertical roller mill 2 is utilized as an apparatus for preliminarily crushing materials, it will be initially required for the vertical roller mill to crush materials of relatively large grain sizes and to effectively crush the same in substantially one crushing process. Because of such requirements, it will be necessary for such a vertical roller mill to have a large pressing force or power in comparison with a generally utilized vertical roller mill.

Namely, since the materials fed into the vertical roller mill 2 contain materials, which in percentage, are coarse and have relatively large sizes, it is therefore necessary to effectively crush the materials with a reduced crushing operation time, resulting in the requirement of large pressing force.

As described above, therefore, since the vertical roller mill utilized as the preliminarily crushing means generates large vibrations when compared with a usual vertical roller mill, in the actual operation, it is necessary for the preliminarily crushing type vertical roller mill to be operated with a pressing force of the rollers at a value considerably lower than a desired value for the effective crushing operation, thus causing a significant problem. In addition, from a mechanical point of view, an additional attention has to be paid to obtain a vibration-proof design, thus being not economical.

Furthermore, materials to be newly crushed usually have various sizes, properties such as physical characteristics and the like, and these materials will be continuously fed in the actual crushing operation. Such variations or changes of the sizes and properties of the newly fed materials directly affect a one-pass crushing apparatus of the vertical roller mill type shown in FIG. 10.

Thus, in a case where materials having different sizes are fed, the vibration level or degree will change, and in association therewith, the driving capacity of the vertical roller mill has to be changed, thus also providing a troublesome problem.

In a case where materials having different properties are fed and materials which are hardly crushed are fed, the crushing capacity of a crushing plant is degraded, so that an amount of the material to be supplied to the vertical roller mill is reduced, and hence, the thickness of the materials to be taken into the gap between the rollers and the table of the vertical roller mill is also reduced. As a result, the vibration level will increase and the crushing capacity of the crushing plant will be further degraded. On the contrary, when materials relatively easily crushed are fed, the crushing capacity of the crushing plant can be increased, so that the material thickness between the rollers and the table is also increased, resulting in a decrease of the vibration level. However, in this case, since the material thickness increases, a pressure receiving area of the materials for receiving the roller pressure is increased, so that the press crushing force to be applied to a unit area will be substantially reduced, resulting in the lowering of the actual crushing efficiency.

As described above, in the so-called one-pass crushing apparatus, the grain sizes and the properties, of the materials to be crushed directly affect operation so that the crushing apparatus cannot always be operated under optimum constant and stable crushing conditions.

FIG. 11 represents another example of the prior art such as disclosed in the Japanese Patent Laid-Open Publication No. 116751/1988. FIG. 11 shows a schematic diagram of a crushing apparatus, and referring to FIG. 11, materials fed through a material feed inlet port 8 into a vertical roller mill 9 are once preliminarily or primarily crushed therein and the crushed materials are conveyed to a screening device 11 through a bucket elevator 10. The preliminarily crushed materials are screened by a screening surface 12 of the screening device 11, and the coarse materials in the materials fed from the vertical roller mill 9 each having a grain size larger than a predetermined size more than 2.5 mm, for example, are separated in the screening device 11 and then returned to the vertical roller mill 8 through a chute 13 for re-crushing the coarse materials.

On the contrary, relatively finely crushed materials separated from the coarse materials described above are conveyed to a tube mill 15 through a chute 14 for secondary fine crushing operation. The materials finely crushed by the tube mill 15 are classified by a separator in accordance with their grain sizes, and the materials each having a grain size larger than a predetermined value are again returned to the tube mill 15 for re-crushing the same. The fine materials not returned to the tube mill 15 are taken out therefrom as products through a chute 17. A crushing apparatus of such a type may be called a screening re-circulation type of crushing apparatus because of its nature.

The latter mentioned prior art crushing apparatus aims, in comparison with the former mentioned prior art crushing apparatus, to improve the crushing efficiency of the tube mill, that is, to feed the crushed materials of further small grain sizes to the tube mill by screening the coarse materials, each having a grain size more than the predetermined size such as 2.5 mm, once crushed by the vertical roller mill and returned again to the vertical roller mill for the re-crushing thereof.

However, in the latter mentioned screening re-circulation type crushing apparatus, since the materials once crushed but each having grain size of more than a predetermined value such as more than 2.5 mm are returned to the vertical roller mill 9, the grain sizes of the materials in the vertical roller mill 9 are not substantially changed even after the preliminarily or primarily crushing operation therein. In other words, even in the screening re-circulation type crushing apparatus, the problem of causing large vibrations during the crushing operation is not solved, as is caused in the one-pass type crushing apparatus.

In addition, in the screening re-circulation type crushing apparatus, the influences caused by the change of property of newly fed materials to be crushed in the vertical roller mill are given more largely to the vertical roller mill than the case of the one-pass type crushing apparatus. These influences will be also imparted proportionally to the entire operation of a plant, thus increasing the possibility of instable crushing operation thereof.

Namely, in this crushing apparatus, the materials once crushed by the vertical roller mill are separated into coarse and relatively fine ones by the screening device, the coarse ones then being returned to the vertical roller mill and the fine ones being fed to the tube mill for the secondary finely crushing operation.

Accordingly, amounts of the coarse and fine materials after the screening operation are decided by the grain sizes of the materials crushed by the vertical roller mill. As a matter of nature, the grain sizes of the materials to be fed into the vertical roller mill are not usually constant, and in addition to this fact, the returned coarse materials to the vertical roller mill varying in their amount are continuously added to and mixed with the materials newly fed into the vertical roller mill.

Accordingly, the total amount in the vertical roller mill always changes and this fact magnifies the change of the property of the materials to be crushed in the vertical roller mill as well as the changes of their grain sizes. This will be applied even to a case where the feeding amount of the materials to be newly fed into the vertical roller mill is relatively constant.

Consequently, the magnitude of vibrations of the vertical roller mill always change, as well as the amount of electric power consumption for the vertical roller mill.

Furthermore, since the amount of the secondary separated fine materials to be fed to the tube mill 15 always varies in size, the tube mill 15 cannot be constantly stably operated. Namely, in the screening re-circulation type crushing apparatus of the conventional type described above, the circulation amount of the materials to the vertical roller mill 9 and the supply amount thereof to the tube mill 15 are not optimumly controlled in accordance with the change of properties of materials to be newly fed.

Furthermore, in a crushing plant such as for crushing cement clinker, the crushing capacity is usually of 100 ton/hour to 150 ton/hour, and when materials of such an amount are subjected to screening treatment, materials of about 130 to 200 ton including the circulation amount must be treated per one hour, thus requiring the screening device to have a considerably large size and treating capacity. It is also difficult to use the screening net means for a long time, as it is uneconomical and troublesome to maintain.

SUMMARY OF THE INVENTION

An object of the present invention is to substantially eliminate defects or drawbacks encountered in the prior art and to provide an apparatus and method for crushing materials by utilizing a vertical roller mill capable of possibly reducing vibrations of the vertical roller mill caused during the material crushing operation and achieving an optimum material press crushing force.

Another object of the present invention is to provide an apparatus and method for crushing materials such as cement clinker by utilizing a vertical roller mill capable of possibly reducing vibrations of the vertical roller mill caused during the material crushing operation and achieving always stable operation of the vertical roller mill even in consideration of changes in grain sizes and properties of the materials to be fed in and crushed by the vertical roller mill.

These and other objects can be achieved according to the present invention, in one aspect by providing an apparatus for crushing materials comprising:

a vertical roller mill into which materials to be crushed are fed, the vertical roller mill including an outer housing, a table horizontally arranged in the housing and rollers disposed above the table;

a driving means for rotating the table;

a pressing means for pressing the rollers against the table to crush the materials between the table and the rollers, substantially the whole amount of the crushed materials being taken out from the vertical roller mill;

a distributing device operatively connected to the vertical roller mill for distributing at least a portion of the crushed materials conveyed from the vertical roller mill and returning the portion of the crushed materials to the vertical roller mill; and a tube mill installed downstream of the vertical roller mill for carrying out a secondary crushing operation.

In a preferred embodiment, the crushing apparatus may further comprise a distribution vane which is disposed in the distributing device and of which inclination is changed to adjust the returning amount of the crushed materials from the distributing device towards the vertical roller mill, a driving means for driving the distributing vane, a control circuit for controlling the driving means for the distributing vane and a detector connected to the control circuit for detecting the power consumption of the driving means for driving the table of the vertical roller mill, wherein the inclination of the distributing vane is controlled in accordance with the power consumption of the motor.

In another embodiment, the crushing apparatus may further, comprise a detector for detecting the power consumption of the driving means for driving the table of the vertical roller mill and a control circuit connected to the detector, the control circuit being connected to the pressing means, wherein a pressing force of the pressing means to the rollers is controlled by the control circuit in accordance with the power consumption of the motor.

In another aspect of the present invention, there is provided a method of crushing materials by utilizing a crushing apparatus including a vertical roller mill provided with a rotatable table and rollers, a distributing device for distributing materials crushed by the vertical roller mill and a tube mill installed downstream the vertical roller mill, the method comprising the steps of:

feeding materials to be crushed into the vertical roller mill;

crushing the materials by a pressing force of the rollers of the vertical roller mill;

taking out substantially an entire amount of the crushed materials from the vertical roller mill and conveying the same to the distributing device;

returning the crushed materials once conveyed to the distributing device to the vertical roller mill by an amount of 20% or more in weight ratio with respect to materials which are to be newly fed into the vertical roller mill;

re-crushing the materials including new materials and the materials returned by the vertical roller mill; and feeding the crushed materials to the tube mill for carrying out a secondary crushing operation.

In the crushing method, the return amount of the crushed materials from the distribution device is controlled in accordance with the power consumption of the rotatable table of the vertical roller mill, and the pressing force of the roller means is controlled in accordance with power the consumption of the rotatable table of the vertical roller mill.

In the present embodiments, cement clinker is preferably utilized as the material to be crushed.

According to the present invention of the characteristics described above, the crushing apparatus includes a vertical roller mill for preliminarily or primarily crushing materials. The materials fed into the vertical roller mill enter into a gap between the rollers and the table of the vertical roller mill and are crushed by pressing force applied to the rollers. Substantially the whole amount of this crushed material is taken out from the vertical roller mill and then conveyed to the distributing device. In the distributing device, the materials are distributed as they are and a portion of the materials is returned to the vertical roller mill. The returned materials and the materials newly fed into the vertical roller mill are again crushed thereby increasing the bulk density of the materials to be crushed between the table and the rollers of the vertical roller mill to reduce the percentage of void of the materials.

Accordingly, the magnitude of vibrations of the vertical roller mill caused during the material crushing operation can be remarkably reduced and the crushing operation can be performed by the optimum pressing force of the rollers, thus achieving the improved crushing efficiency. The reduction of the vibrations of the vertical roller mill may result in the simple and compact structure thereof, thus being economical. The power consumption of the vertical roller mill can be remarkably increased, thus improving the crushing capacity thereof, and the bulk density of the materials to be crushed is also increased, thus reducing the rolling resistance of the rollers, resulting in the improvement of the crushing efficiency.

In addition, the returning amount of the crushed materials from the distributing device is controlled in accordance with the power consumption of the rotatable table of the vertical roller mill, and the pressing force of the rollers is controlled in accordance with a power consumption of the rotatable table of the vertical roller mill. Accordingly, the material crushing operation can be performed with the optimum press crushing force of the rollers.

In the preferred embodiment, when the cement clinker is utilized as materials to be crushed, the crushing efficiency can be remarkably improved by returning, again to the vertical roller mill, the materials once crushed in the vertical roller mill and conveyed in the distributing device by about 20% or more, in weight ratio, with respect to the materials to be newly fed into the vertical roller mill because in such case, the bulk density of the materials can be always maintained high.

BRIEF DESCRIPTION OF THE DRAWINGS

For a better understanding of the present invention and to show how the same is carried out, reference is first made, by way of preferred embodiments, to the accompanying drawings, in which.

DESCRIPTION OF THE PREFERRED EMBODIMENTS

Figure 1:
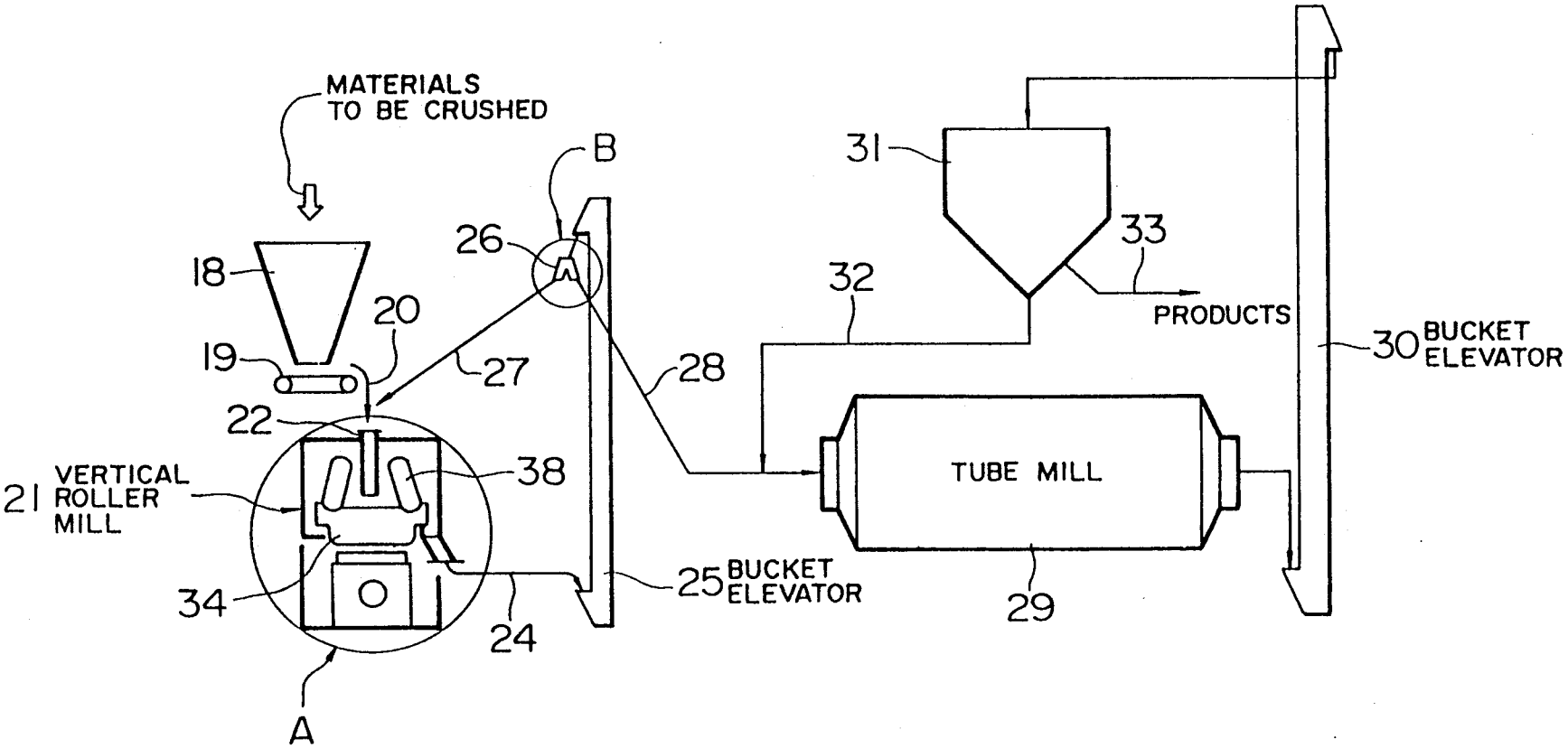
FIG. 1 is a schematic diagram of a first embodiment of a crushing apparatus according to the present invention.

FIG. 1 is a schematic diagram showing one embodiment according to the present invention.

Referring to FIG. 1, in this embodiment, it is assumed that cement clinker is treated as the material to be crushed. The cement clinker is fed from a material feed hopper 18 by a predetermined constant amount per unit time by means of a constant amount feeder 19 and fed, by means of a chute 20, into a vertical roller mill 21 through an inlet port 22 thereof. The vertical roller mill 21 comprises a table member 34 disposed substantially horizontally and a plurality of rollers 38 arranged above the peripheral portions of the table 34. Substantially all of the materials fed into and preliminarily or primary coarsely crushed by the vertical roller mill 21 is taken out through a chute 24 having one end disposed at a portion below the table 34 of the vertical roller mill 21.

The crushed materials taken out from the vertical roller mill 21 through the chute 24 are conveyed by a bucket elevator 25 into a distributing device 26 installed at the upper part of the bucket elevator 25, by which a portion of the crushed materials from the vertical roller mill 21 is returned, as it is, to the inlet port 22 thereof through a chute 27. And the remainder thereof is fed through a chute 28 into a tube mill 29 installed downstream the vertical roller mill 21 for carrying out a secondary crushing operation therein. The tube mill 29 is of a horizontal structure comprising a drum body having a horizontal axis in which a crushing means is disposed. The materials finely crushed by this crushing means of the tube mill 29 are guided to a separator such as an air separator 31 through a bucket elevator 30. In the separator 31, the crushed materials are classified in accordance with their grain sizes and the coarsely crushed materials are again returned through a chute 32 to the tube mill 29 for the re-crushing operation therein. The finely crushed materials separated in the separator 31 are then taken out as products through a chute 33.

Figure 2:
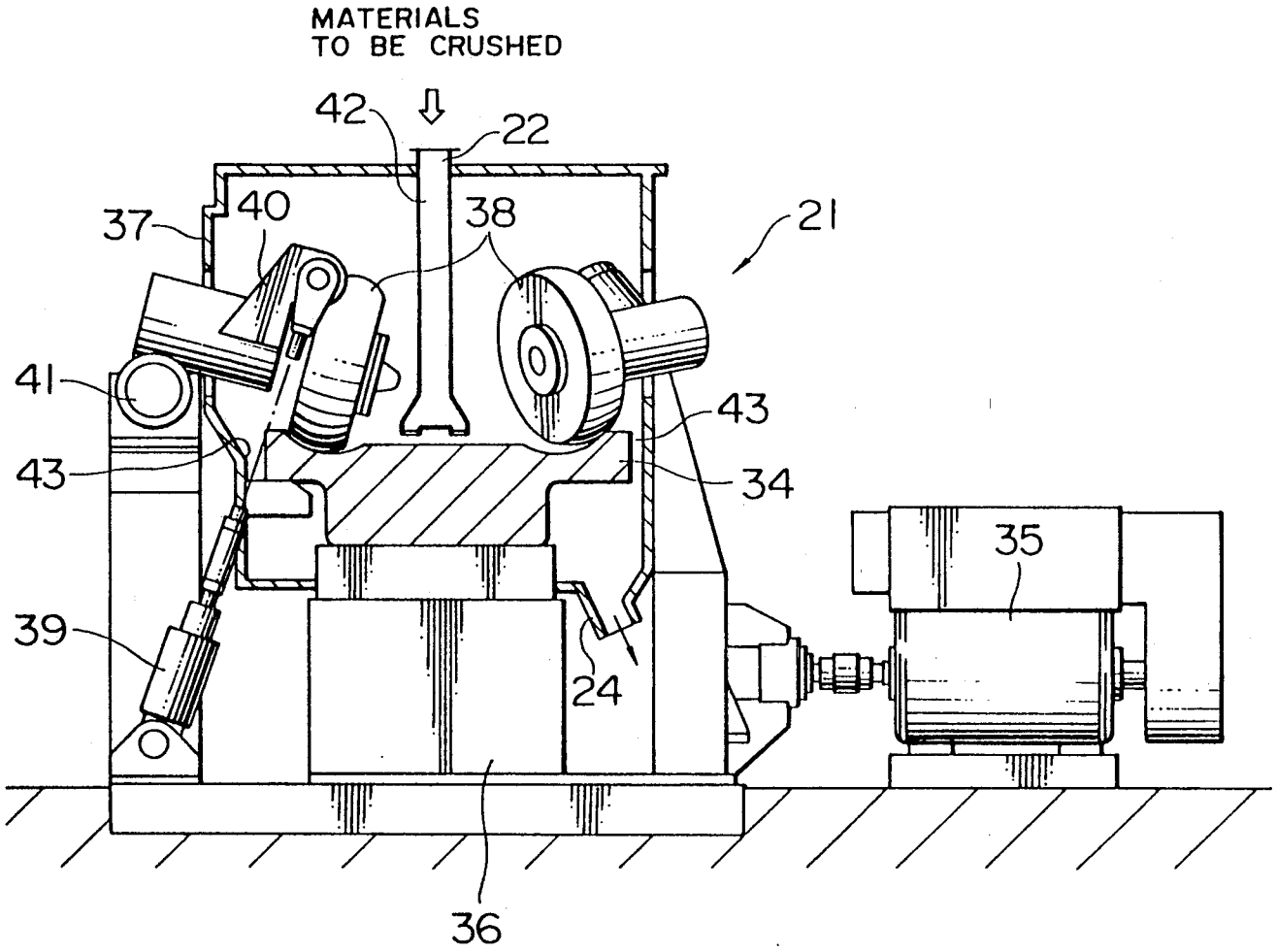
FIG. 2 is an elevational view partially in section of a vertical roller mill of the crushing apparatus of FIG. 1.

FIG. 2 is a sectional view of the vertical roller mill 21 as shown by arrow A in FIG. 1 in an enlarged scale. The vertical roller mill 21 is disposed substantially horizontally in a housing 37 and includes the table 34 having a perpendicular axis. The table 34 is driven to be rotated about the axis by means of a motor 35 and a speed reduction device 36. In the housing 37, there is also arranged a plurality of, three, for example, rollers 38 which are driven by a pressing device such as hydraulic cylinder means 39 so as to be press contacted to the surface of the table 34. The rollers 38 are supported by arms 40 which are angularly separated in positions about support shafts 41, respectively, thereby pressing the rollers 38 against the surface of the table 34. The material inlet port 22 is disposed to the upper portion of the housing 37 at substantially the central portion thereof. The inlet port 22 is also communicated with a chute 42 disposed in the housing 37 substantially coaxially with the perpendicular axis of the table 34 so that the materials fed through the inlet port 22 are fed at substantially the central portion of the table surface. There exists a circumferential gap 43 between the outer peripheral surface of the table 34 and an inner wall of the housing 37, and the materials crushed between the table 34 and the rollers 38 are fed through this gap 43 into the chute 24 and then to the bucket elevator 25.

Figure 3:
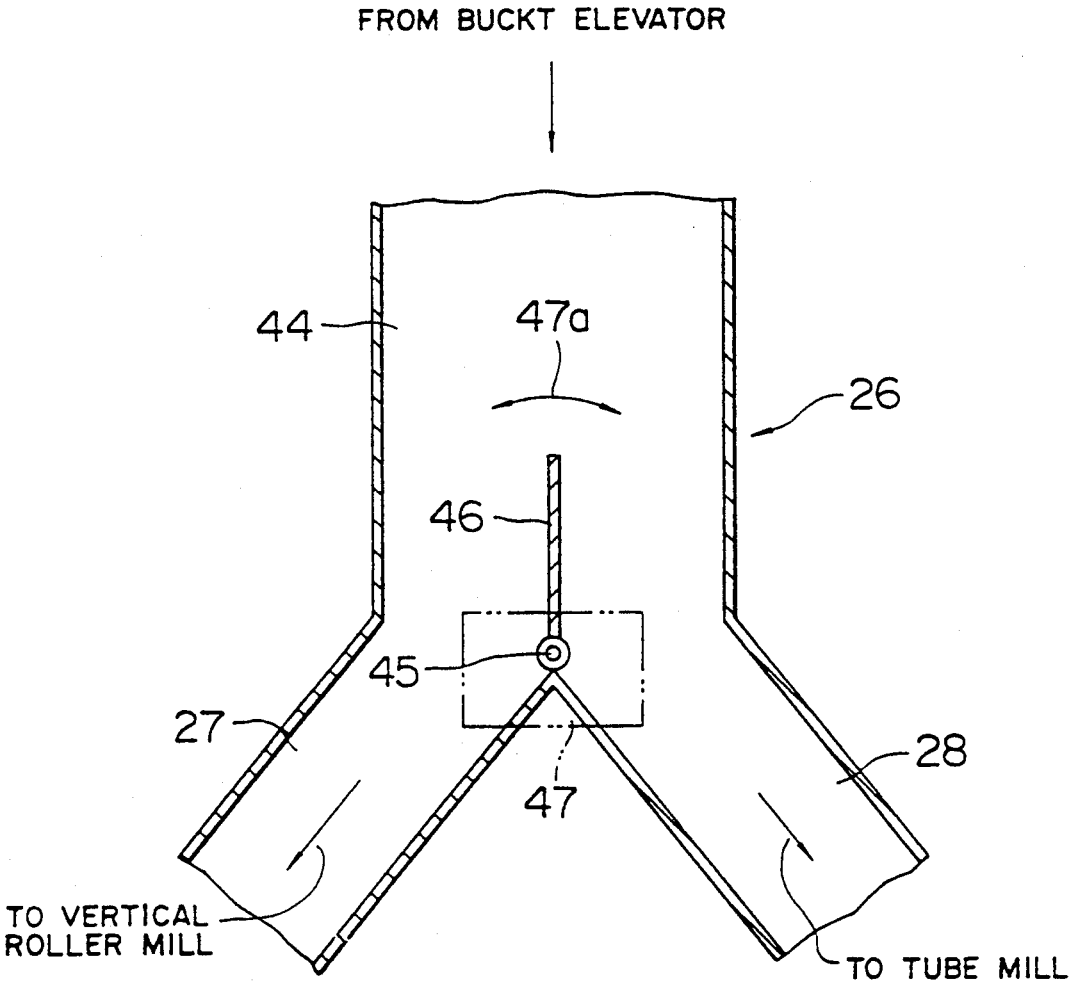
FIG. 3 is a brief sectional view of a distributing device of the crushing apparatus of FIG. 1.

FIG. 3 is an elevational section of a distributing device 26, as shown by arrow B in FIG. 1, which is operatively connected to the bucket elevator 25. Referring to FIG. 3, the materials crushed in the vertical roller mill 21 are fed into the distributing device 26 through the bucket elevator 25 from the upper portion of a housing 44 of the distributing device 26. The lower portion of the housing 44 is separated into two parts, one being connected to the chute 27 communicated to the vertical roller mill 21 and the other being connected to the chute 28 communicated to the tube mill 29. At the central portion of these two portions there is disposed a shaft 45 having a horizontal axis, and a distributing vane 46 is mounted to the shaft 45 changeable in its inclination as shown by an arrow 47*a*. The distributing vane 46 is operated by a distributing vane driving means 47 so that the vane 46 can be set to a position having a desired inclination. The amount or ratio of the materials crushed by the vertical roller mill 21 and to be distributed to the chutes 27 and 28 can be adjusted by changing the inclination angle of the distributing vane 46. Merits and advantages caused by these structures will be understood by the following disclosures for solving the problems encountered in the conventional apparatus.

First, the reason why the vertical roller mill 21 for preliminarily crushing the materials generates a large vibration will be explained by taking into consideration one example in which cement clinker is used as the material to be crushed.

Figure 4:
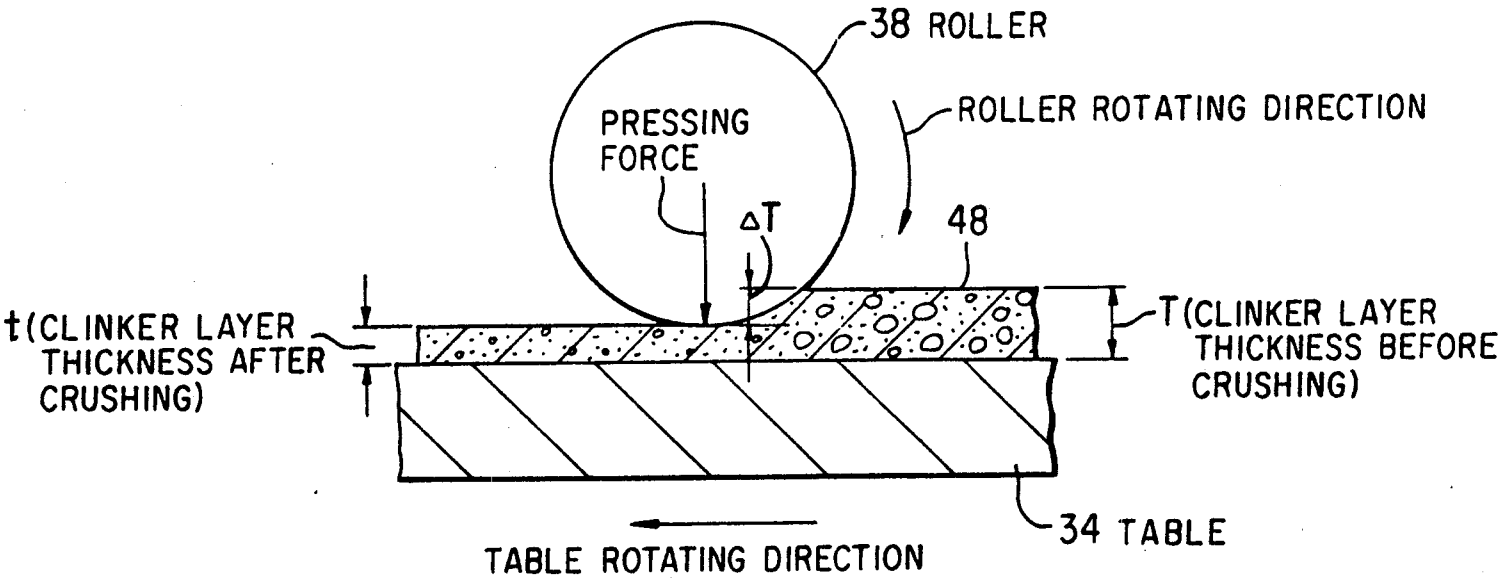
FIG. 4 is a view for the explanatory of the crushing operation between a table and rollers of the vertical roller mill of FIG. 2.

With reference to FIG. 4 schematically showing the crushing mechanism including the table 34 and the rollers 38, when the table 34 is rotated about its perpendicular axis, the materials 48 to be crushed on the table 34 enter, i.e. are taken, between the rollers 38 and the table 34 and crushed by the pressing force of the rollers 38. A bulk density G1 of the clinker before passing between the table 34 and the rollers 38 is usually about 1.5 and a bulk density G2 after the crushing of the cement clinker is about 2.5.

Accordingly, assuming that a thickness of the clinker layer before the crushing is T and that after the crushing is t, an equation $T/t=1.67$ will be obtained. That is, the layer thickness change amount $\Delta T$ $(=T-t)$ is 0.4 T. The vertical roller mill usually utilized for the preliminary crushing of the cement clinker has a crushing capacity to crush the cement clinker so as to have a thickness t of about 30 mm. Accordingly, the thickness of the cement clinker before crushing T is assumed to be about 50 mm and the layer thickness change is to be about 20 mm. The periphery of the table 34 is usually rotated with a rotating speed of about 3.5 m/sec, being relatively large, and since the cement clinker on the table 34 is rotated and taken in under such large rotating speed of the table 34, the layer change amount $\Delta T$ frequently changes violently in response to the change of properties such as physical characteristics of the cement clinker and the amount of the cement clinker to be crushed. According to such changes, the rollers 38 violently change their vertical positions, resulting in the generation of large abnormal magnitude vibrations.

In the prior art, in order to eliminate such vibrations, it was attempted to lower the downward pressing force of the rollers and to lower the rotating speed of the table thereby reducing the taking in speed to the rollers. However, in the former attempt, the lowering of the pressing force of the rollers results in a lowering of the crushing efficiency. The power consumption of the vertical roller mill also decreases and accordingly, a larger vertical roller mill is required to obtain the same crushing capacity. However, in the latter attempt, the power consumption of the vertical roller mill also decreases, so that a larger vertical roller mill is hence disadvantageously required.

Taking the above technical matters into consideration, the inventors of the subject application were considered that the most effective structure of the vertical roller mill for the preliminary crushing for significantly reducing the vibrations thereof should be designed so as to make small the material layer thickness change amount ΔT.

Namely, since the new materials to be crushed such as clinker are mainly composed of coarse grains, the percentage of voids is large and bulk density is small. Accordingly, such materials are pressed and crushed, the volume thereof is remarkably reduced, and hence, the material layer thickness is largely changed. The inventors were therefore considered to make large the bulk density of the materials to be bitten and crushed between the table and the rollers and carried out various investigations.

As this result, it was concluded to be most effective that the materials to be preliminarily crushed by the vertical roller mill are not to be separated into fine materials and coarse materials and that these preliminarily crushed materials be mixed as they are with new materials such as cement clinker.

Assuming that the materials to be crushed of the layer thickness T have a bulk density G1 and the materials of the layer thickness t have a bulk density G2, the following equations will be obtained.

$$G1 \cdot T = G2 \cdot t \quad (1),$$

and accordingly, $$T/t = G2/G1 \quad (2)$$

Accordingly, it will be found that in order to reduce the amount of layer thickness change, it is desired to increase the bulk density G1 of the materials to be crushed by the vertical roller mill.

The results of experiments carried out by the inventors will be described hereunder.

Figure 5:
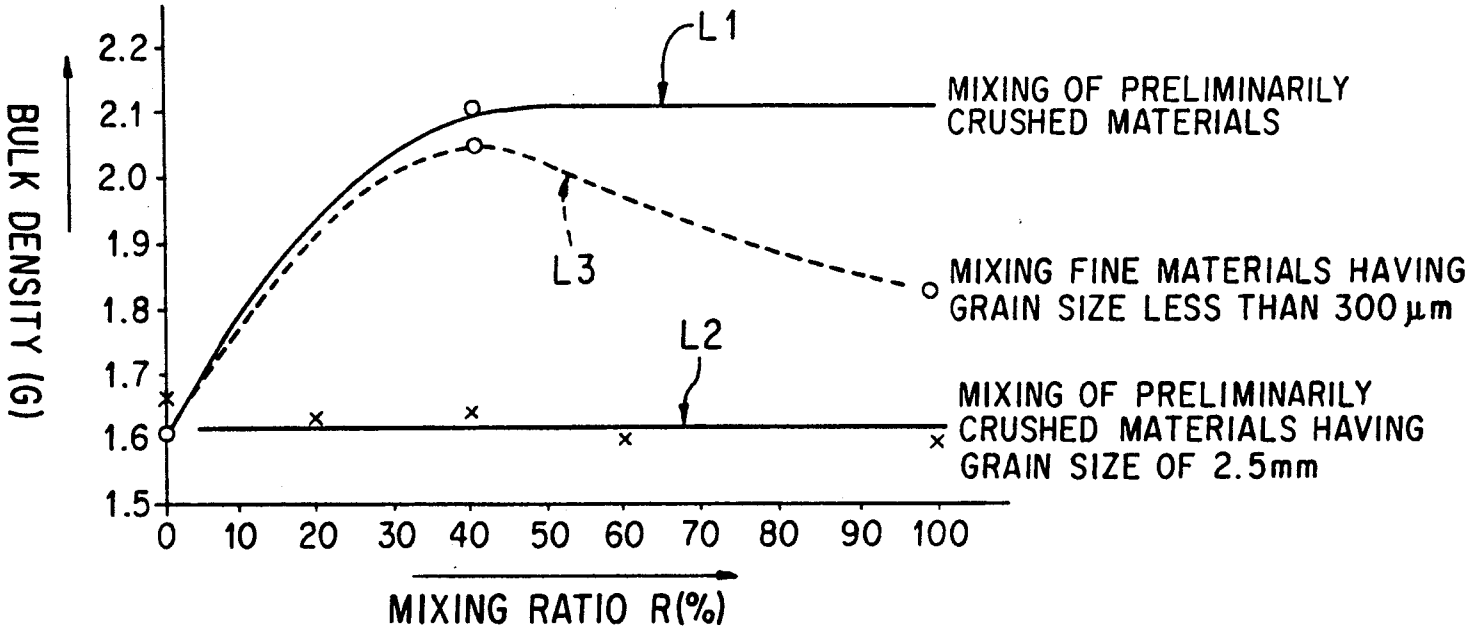
FIG. 5 is a graph showing relationship of a bulk density of cement clinker powder with respect to a powder mixing ratio.

FIG. 5 is a graph showing a relationship between the mixing ratio R and the bulk density G of powder material to be supplied to the vertical roller mill 21, based on the experiments, in which the value R is represented as follows.

$$R = W1/(W1 + W2) \quad (3)$$

in which the symbol W2 represents the weight of cement clinker as new materials to be fed into the vertical roller mill 21 through the chute 20 and crushed therein and the symbol W2 represents the weight of cement clinker as materials to be fed again into the vertical roller mill 21 through the chute 27 from the distributing device 26. In FIG. 5, a solid line L1 shows a characteristic feature, as shown in FIG. 1, in a case of the cement clinker fed and mixed in the vertical roller mill 21 through the chute 27 being the one-pass crushed materials, i.e. preliminarily crushed materials, a solid line L2 shows a characteristic feature in a case of the cement clinker fed and mixed in the vertical roller mill 21 through the chute 27 after the distribution in the distributing device 26 being the preliminarily crushed materials each having a grain size of more than 2.5 mm, and a dotted line L3 shows a characteristic feature in a case of minute powders each having a powder size of less than 300 μm being fed and mixed in the vertical roller mill through the chute 27.

Figure 11:
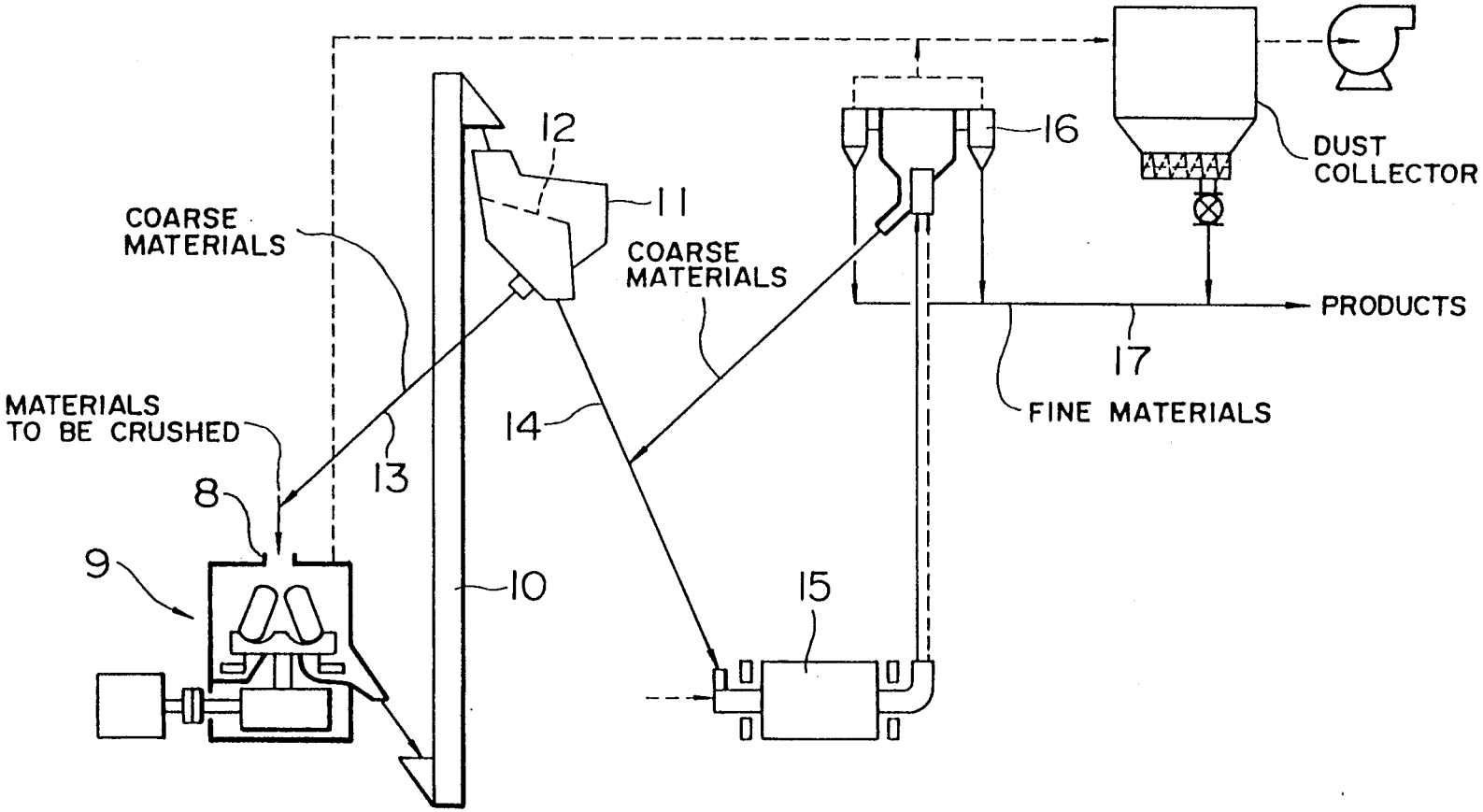
FIG. 11 PRIOR ART

As represented by the line L2, in the case of the materials of each grain size being more than 2.5 mm, the bulk density thereof has a low value substantially equal to the bulk density of 1.61 of the cement clinker itself regardless of the mixing ratio R. Accordingly, it will be understood that problems caused in the case of the one-pass crushing apparatus will be also caused in the case of the screening re-circulation crushing apparatus as described hereinbefore with reference to FIG. 11.

As represented by the line L3, in the case of fine powders each having a powder size less than 300 μm being mixed, the bulk density G increases until the mixing ratio of the fine powders becomes 40%, but when the mixing ratio R further increases, with the peak of 40%, the bulk density G decreases. Accordingly, when only fine powder materials are mixed, the operating condition of the vertical roller mill 21 is made instable when the mixing ratio is changed.

On the contrary, as represented by the line L1, in the case of the preliminarily crushed materials being mixed as they are, the bulk density G increases to a value 1.95 from a value 1.55 until the mixing ratio R becomes 20% and is maintained to a large value of about 2.1 in the mixing ratio R more than 20%. Accordingly, it will be found that it is remarkably effective for solving the problems caused in the prior art to mix the preliminarily crushed materials as they are, with the new materials fed into the vertical roller mill.

As is apparent from FIG. 5, according to the present invention, as represented by the line L1, it was evidenced in the experiments of the inventors that the bulk density of the materials to be crushed by the vertical roller mill 21 is made large when the mixing ratio is more than about 20%, preferably more than 25%, and the magnitude of vibrations of the vertical roller mill 21 can be therefore effectively reduced at that mixing ratio. Furthermore, the bulk density of a relatively large value is maintained constantly at a mixing ratio R of more than about 40%. Accordingly, in this range, even if the property of the clinker fed through the chute 20 can be changed, the bulk density thereof in the vertical roller mill 21 is maintained substantially constant, so that the vibrations may be effectively suppressed.

Therefore, according to the embodiment represented by the apparatus shown in FIG. 1, the vibrations of the vertical roller mill 21 can be remarkably reduced only by returning, by a predetermined constant amount, the materials preliminarily crushed by the vertical roller mill 21 and distributed in the distributing device 26. Thus, an optimum roller pressing force can be applied for the crushing of the materials in the vertical roller mill 21 with increasing driving efficiency, and an improved crushing capacity can be realized with substantially no design change of the vertical roller mill.

Furthermore, as shown in FIG. 3, the amount of re-circulation of the materials to the vertical roller mill 21 from the distributing device 26 can be optionally adjusted by changing the degree of opening inclination of the distributing vane 46 disposed in the distributing device 26, whereby even in a case where the operating condition be changed in accordance with the property of the new materials to be crushed, the operating condition can be maintained to be constant by changing the re-circulation amount of the materials from the distributing device 26. The distributing device 26 has itself a relatively simple and compact structure.

The crushed materials to be fed to the tube mill 29 can be also adjusted to be constant in amount, thus the tube mill 29 can be also maintained stably in its operating condition.

As described hereinbefore, according to the first embodiment of the present invention, the problems encountered in the prior art can be effectively solved by a crushing apparatus having a relatively simple structure and the effects and advantages thereof were confirmed by the experiments of the inventors.

In the described embodiment, when materials difficult to be crushed are newly fed and the crushing capacity of the crushing apparatus is decreased, the new materials to be fed to the vertical roller mill 21 will be reduced in amount, and as the result, the amount of the preliminarily crushed materials taken out from the vertical roller mill 21 is also reduced. In such case, when the distributing device 26 maintains its distributing ratio constant, the re-circulation amount of the materials to the vertical roller mill 21 from the distributing device 26 is also reduced. As the result, the total amount of the materials to be fed to the vertical roller mill 21 is hence reduced, thus reducing the power consumption, as well as the crushing efficiency.

On the contrary, when materials easily crushed are newly fed and the crushing capacity of the crushing apparatus is increased, the new materials to be fed to the vertical roller mill 21 will be increased in amount. In such a case, when the distributing device 26 maintains its distributing ratio to be constant, the re-circulation amount of the materials to the vertical roller mill 21 from the distributing device 26 is also increased.

As the result, the total amount of the materials to be fed to the vertical roller mill 21 is hence increased, the power consumption of the motor 35 also being increased. If the vertical roller mill 21 is operated until this time at the rated value of the motor 35, the increasing of the amount of the materials to be crushed may result in the increasing of the power consumption of the vertical roller mill 21, which may cause an overload of the motor 35, and being dangerous for the motor operation.

Accordingly, in the foregoing first embodiment, it may be required to provide a motor 35 having a relatively large capacity with respect to the consuming power of the utilized vertical roller mill, and furthermore, since the power consumption of the vertical roller mill is naturally changed in accordance with the property change of the materials to be crushed, the change of the crushing capacity of the entire crushing apparatus may be increased accordingly, thus being inconvenient.

A second embodiment of the present invention is provided for effectively improving the above defects of the first embodiment and will be described hereunder with reference to FIGS. 6 to 7.

Figure 6:
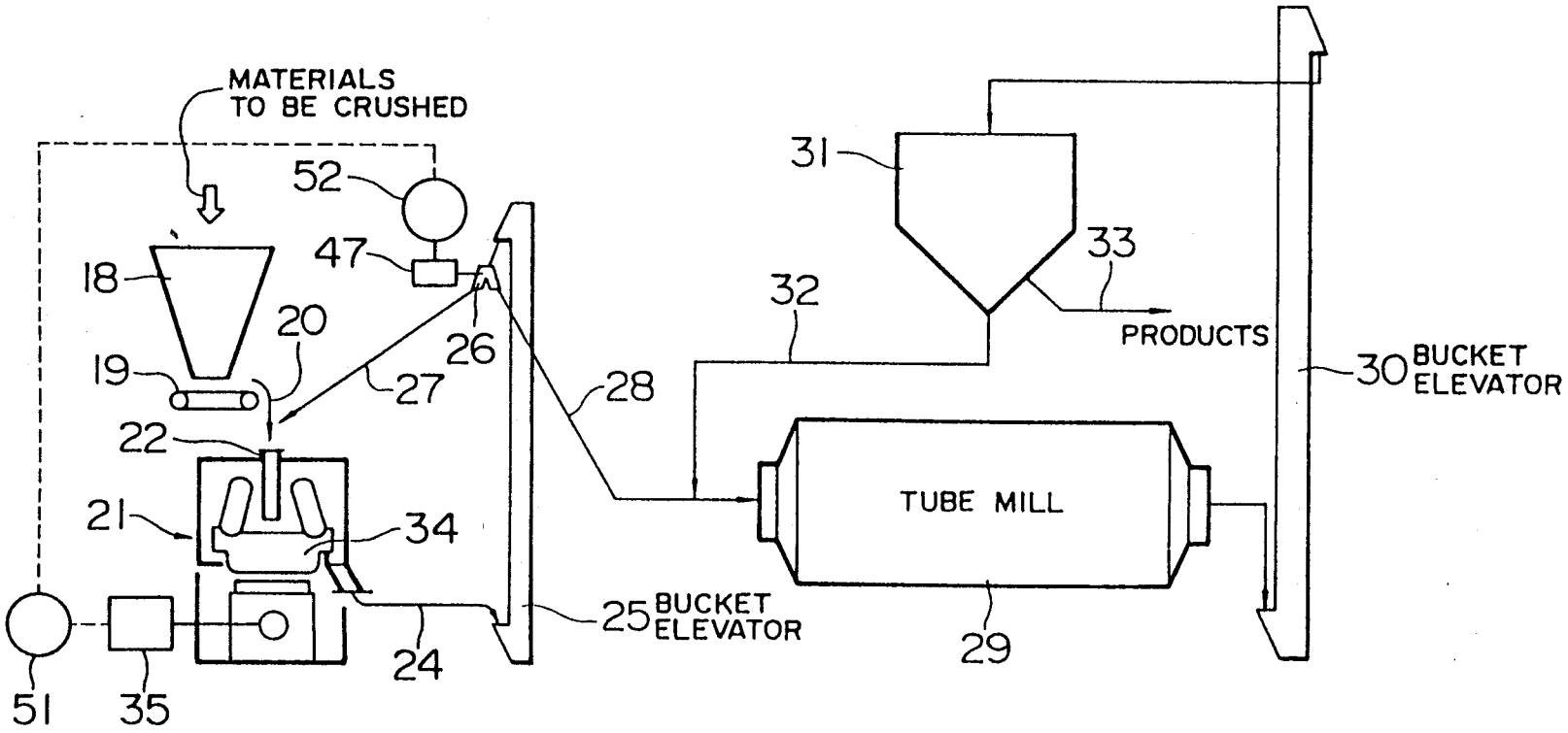
FIG. 6 is a schematic diagram similar to that of FIG. 1, but showing a second embodiment according to the present invention.

FIG. 6 is a schematic diagram showing the second embodiment according to the present invention, in which like reference numerals are added to members and devices corresponding to those of the first embodiment shown in FIGS. 1 to 5. In the second embodiment with reference to FIG. 6, it is attempted to make power consumption of the vertical roller mill 21 always constant by automatically deciding the distributing ratio of the distributing device 26 on the basis of the consuming power of the driving motor 35 of the vertical roller mill 21. The power consumption of the motor 35 driving the table 34 of the vertical roller mill 21 is detected by a power consumption detection means 51 and the detected power is given to a control circuit 52, which controls a driving means 47 for driving the distributing vane 46 of the distributing device 26. The structure other than these structures of the crushing apparatus of the second embodiment is substantially identical to those of the first embodiment.

Figure 7:
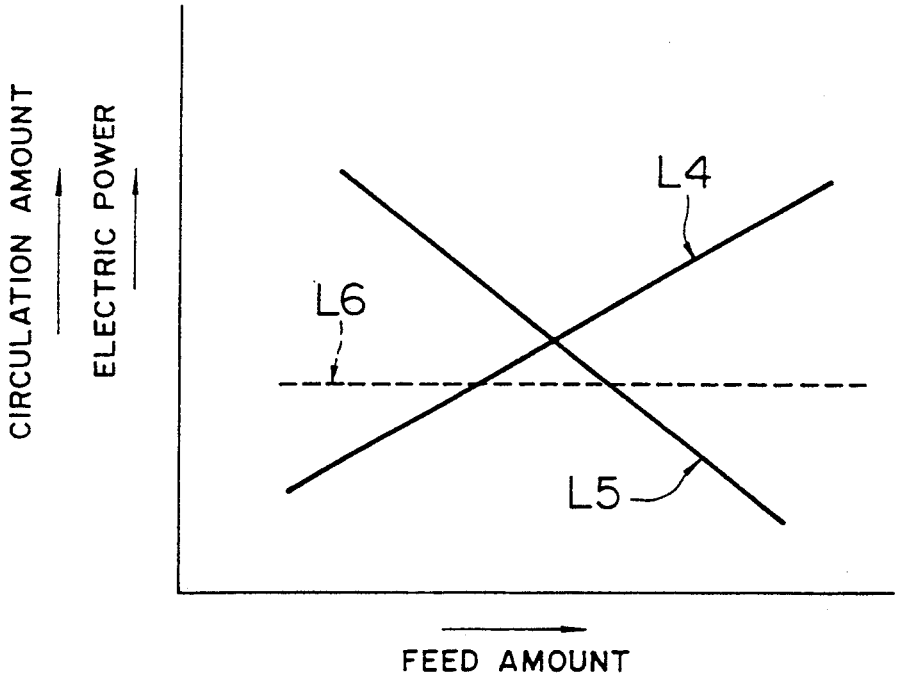
FIG. 7 is a graph for the explanatory of an operation of a control circuit of the crushing apparatus of FIG. 6.

FIG. 7 is a graph for describing the operation of the crushing apparatus shown in FIG. 6. Referring to FIG. 7, when the new materials to be fed through the chute 20 in the vertical roller mill 21 and crushed therein are increased in the amount, the consuming power of the motor 35 detected by the detecting means 51 is increased as shown by a solid line L4. In response to this fact, the control circuit 52 controls the driving means 47 to leftwardly, as viewed in FIG. 3, change the inclination of the distributing vane 46, and according to this change, the re-circulation amount of the materials from the distributing device 26 towards the vertical roller mill 21 is reduced as shown by a solid line L5. By virtue of such operation, the power consumption of the motor 35 for the vertical roller mill 21 can be maintained to be constant as shown by a dotted line L6.

According to the second embodiment represented by FIGS. 6 and 7, in a case where the power consumption of the vertical roller mill 21 changes in accordance with the property change of the materials to be crushed, for example, when the power consumption of the vertical roller mill 21 is reduced and the consuming power of the motor 35 is hence reduced, the control circuit 52 automatically controls the distribution ratio of the distributing device 26 in response to the reduction rate of the consuming power so as to automatically increase the returning amount of the materials towards the vertical roller mill 21.

Accordingly, the total amount of the materials to be fed to the vertical roller mill 21 is increased, and as this result, the power consumption of the vertical roller mill 21 returns to its original value. On the contrary, when the power consumption of the vertical roller mill is increased and the power consumption of the motor 35 is hence increased, the control circuit 52 automatically controls the distributing ratio of the distributing device 26 in response to the increased rate of the consuming power so as to automatically reduce the returning amount of the materials towards the vertical roller mill 21. Accordingly, the total amount of the materials to be fed to the vertical roller mill 21 is reduced, and as this result, the power consumption of the vertical roller mill 21 returns to its original value.

As described above, according to the present embodiment, the power consumption of the vertical roller mill 21 can be always constantly maintained regardless of the property of the materials to be crushed and the consuming power of the vertical roller mill 21 can be optimumly decided, so that it is not necessary to arrange the motor 35 having a capacity more than necessity and the variance in the crushing capacity can be significantly suppressed, thus being effective and advantageous.

Namely, according to this second embodiment, the power consumption of the vertical roller mill 21 performing the preliminary crushing can be easily maintained constantly regardless of the property change of the materials to be crushed and the change of the crushing capacity of the crushing apparatus itself can be suppressed minimumly. Thus, the operating condition of the crushing apparatus can be always stably maintained with the far improved crushing efficiency. Furthermore, there is no need for the location of the vertical roller mill driving motor 35 having a capacity more than necessity, resulting in merits in construction cost.

In this embodiment, although the distributing rate of the distributing device 26 is automatically managed in accordance with the power consumption of the vertical roller mill 21, the distribution rate may be controlled by other means such as remote control means.

Figure 8:
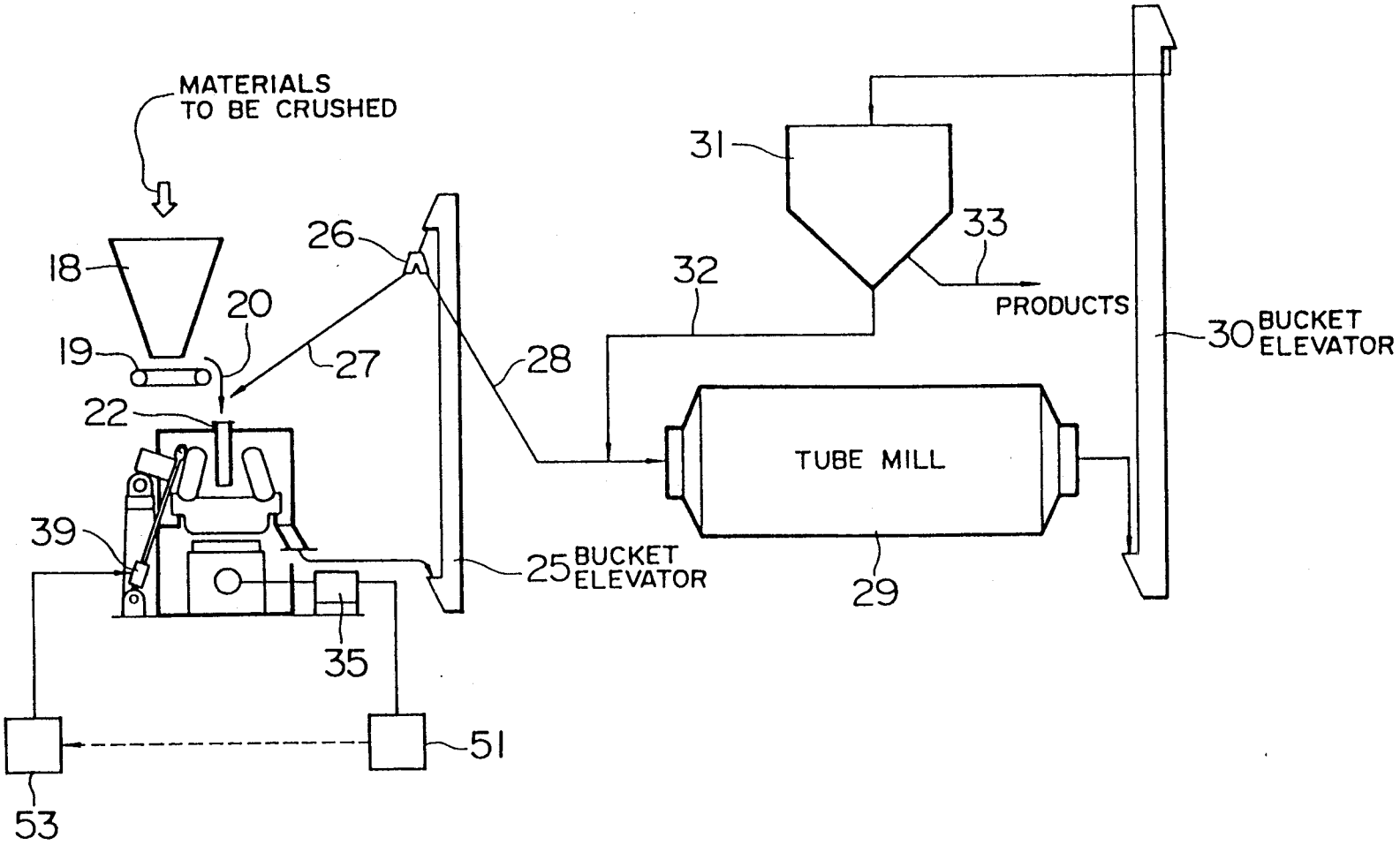
FIG. 8 is a schematic diagram similar to that of FIG. 1 or 6, but showing a third embodiment according to the present invention.
Figure 9:
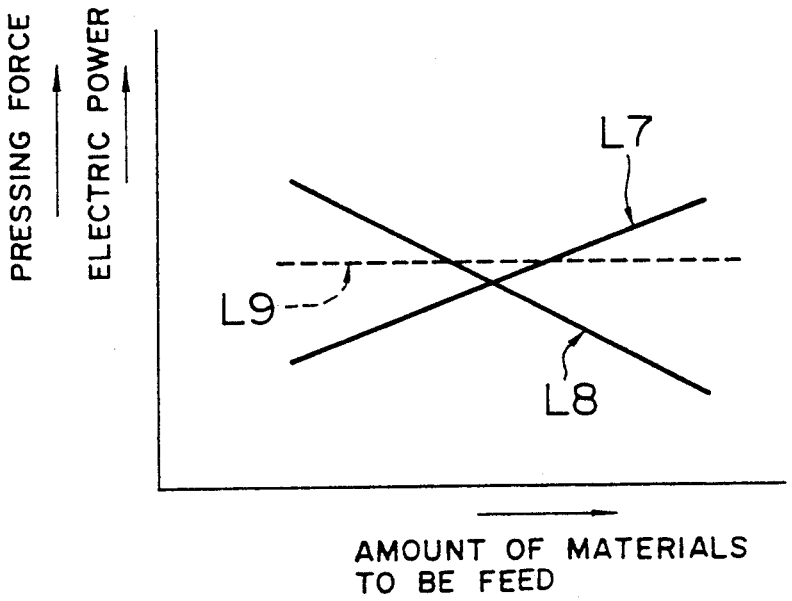
FIG. 9 is a graph for the explanatory of an operation of a control circuit of the crushing apparatus of FIG. 8.
Figure 10:
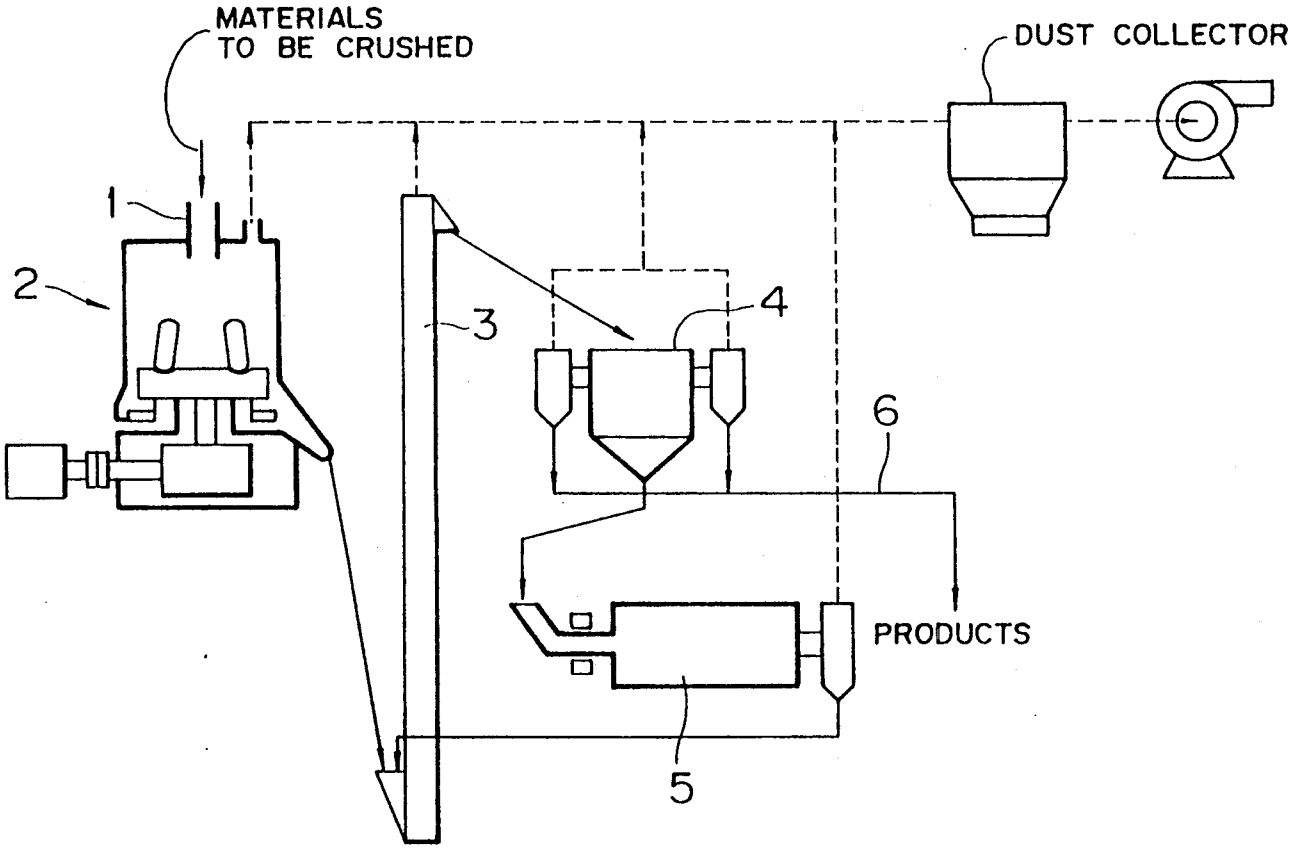
FIG. 10 PRIOR ART
FIGS. 10 and 11 are schematic diagrams of two examples of crushing apparatus of prior art.

FIGS. 8 and 9 further represent an embodiment according to the present invention as the third embodiment, in which like reference numerals are added to members and devices corresponding to those shown in FIG. 1 or 6.

In the third embodiment, a hydraulic cylinder assembly is utilized as the pressing means 39 for pressing the rollers 38 of the vertical roller mill 21 preliminarily crushing the materials, and the hydraulic pressure of the hydraulic cylinder assembly 39 is automatically changed by utilizing the power consumption of the motor 35 to change the pressing force of the rollers 38 and hence thereby maintaining always constant the power consumption of the vertical roller mill 21. The power consumption of the motor 35 is detected by the detecting means 51 and the hydraulic cylinder assembly 39 is controlled by the control circuit 53. In order to achieve these purposes, as shown in FIG. 8, the pressing means 39 is connected to the control circuit 53 and the motor 35 is connected to the detecting means 51, which is operatively connected to the control circuit 53.

FIG. 9 is a graph for describing the operation of the crushing apparatus of the third embodiment shown in FIG. 8. When the materials to be fed to the vertical roller mill 21 from the constant amount feeder 19 through the chute 20 is increased in their amount, the power consumption of the motor 35 to be detected by the detecting means 51 is increased as shown by a solid line L7. At this time, the control circuit 53 is operated in response to an output from the detecting means 51 thereby controlling the pressing means 39, whereby the pressing force of the rollers 38 against the table 34 is reduced as shown by a solid line L8. In thus manner, the power consumption of the motor 35 can be maintained constant as shown by a dotted line L9.

As will be understood from the above description of the third embodiment, this embodiment is particularly suitable for the improvement of the second embodiment. Namely, in the second embodiment, the power consumption of the vertical roller mill 21 is made constant by changing or adjusting the amount of the materials returning to the vertical roller mill 21 by changing the distributing rate of the distributing device 26. In such case, there is the fear of temporarily changing the amount of the materials to be fed to the tube mill 29 for the secondary crushing operation in accordance with the changing of the amount of the materials returning to the vertical roller mill 21, which may cause a temporary disturbance to the operation condition on the side of the tube mill 29 of the crushing apparatus.

According to the third embodiment, such problem of the second embodiment can be solved. That is, the distributing rate of the distributing device 26 is maintained to be always constant and the pressing force of the rollers 38 automatically changes with respect to the changing of the consuming power of the motor 35 of the vertical roller mill 21 in accordance with the property change of the materials to be crushed, whereby the consuming power of the vertical roller mill 21 can be maintained to be always constant.

According to the structure of the third embodiment, since the materials can be always fed to the tube mill 29 substantially stably even if the property of the materials be changed, the operation condition on the side of the tube mill 29 never be disturbed and can be maintained stably. In addition, the consuming power of the vertical roller mill 21 can also be maintained constant. Therefore, the crushing apparatus can be entirely stably operated with the optimum crushing performance and efficiency. To make it possible to automatically change the pressing force of the rollers 38 may be partially based on the fact that the magnitude of vibrations of the vertical roller mill 21 can be significantly reduced by partially re-circulating the preliminarily crushed materials again to the vertical roller mill 21.

Furthermore, it will be easily noted that the tube mill 29, the bucket elevator 30 and the separator 31 may be substituted with other means carrying out substantially the same operations, and the present invention may be adapted to purposes other than the preliminarily crushing operation for the tube mill 29.

It is also to be understood that the present invention is not limited to the described embodiments and many other changes and modifications may be made without departing from the scope of the appended claims.

What is claimed is:

1. A crushing apparatus comprising:

a vertical roller mill into which materials to be crushed are fed, wherein the vertical roller mill includes an outer housing, a table horizontally arranged in the housing and roller means disposed above the table;

means for rotating the table;

means for pressing the roller means against the table to crush the materials between the table and the roller means, where substantially the whole amount of the crushed materials is taken out from the vertical roller mill;

means operatively connected to the vertical roller mill for distributing a portion of the crushed materials conveyed from the vertical roller mill and returning the portion of the crushed materials, without separating coarse and fine materials, to the vertical roller mill; and a tube mill installed downstream the vertical roller mill for receiving the crushed material from the distribution means and for carrying out a secondary crushing operation.

2. The crushing apparatus according to claim 1, wherein the pressing means is a hydraulic cylinder assembly.

3. The crushing apparatus according to claim 1, wherein the materials to be crushed are cement clinker.

4. The crushing apparatus according to claim 1, wherein a pressing force of the pressing means for pressing to the roller means is controlled by the control means in accordance with the power consumption of the motor.

5. A method of crushing materials by utilizing a crushing apparatus including a vertical roller mill provided with a rotatable table and roller means, a distributing means for distributing materials crushed by the vertical roller mill and a tube mill installed downstream the vertical roller mill, the method comprising the steps of:

feeding materials to be crushed into the vertical roller mill;

crushing the materials by a pressing force of the roller means of the vertical roller mill;

taking out substantially all amount of the crushed materials from the vertical roller mill and conveying the same to the distributing means;

returning the crushed materials, without separating coarse and fine materials, conveyed to the distributing means to the vertical roller mill by an amount of 20% or more in weight ratio with respect to materials which are to be newly fed into the vertical roller mill;

crushing again the materials including new materials and the returned materials by the vertical roller mill; and feeding the crushed materials to the tube mill for carrying out a secondary crushing operation.

6. The crushing method according to claim 5, wherein the materials to be crushed are cement clinker.

7. The crushing method according to claim 5, wherein the returning amount of the crushed materials from the distributing means is controlled in accordance with a power consumption of the rotatable table of the vertical roller mill.

8. The crushing method according to claim 5, wherein the pressing force of the roller means is controlled in accordance with a consuming power of the rotatable table of the vertical roller mill.

* * * * *